US007027077B2

(12) United States Patent
Burdenko

(10) Patent No.: US 7,027,077 B2
(45) Date of Patent: Apr. 11, 2006

(54) PLATEN ASSEMBLY FOR THERMAL PRINTER

(75) Inventor: Michael N. Burdenko, Wellesley, MA (US)

(73) Assignee: Polaroid Corporation, Waltham, MA (US)

( * ) Notice: Subject to any disclaimer, the term of this patent is extended or adjusted under 35 U.S.C. 154(b) by 81 days.

(21) Appl. No.: 10/784,327

(22) Filed: Feb. 23, 2004

(65) Prior Publication Data

US 2004/0165053 A1 Aug. 26, 2004

Related U.S. Application Data

(60) Provisional application No. 60/449,737, filed on Feb. 24, 2003.

(51) Int. Cl.
*B41J 11/08* (2006.01)

(52) U.S. Cl. ..... 347/220; 400/658; 400/656

(58) Field of Classification Search ..... 347/220; 400/648, 654, 656, 658, 659
See application file for complete search history.

(56) References Cited

U.S. PATENT DOCUMENTS

| | | | | |
|---|---|---|---|---|
| 4,318,452 | A | 3/1982 | Reitner | 181/207 |
| 4,327,366 | A | 4/1982 | Schafter et al. | 346/76 PH |
| 4,725,853 | A | 2/1988 | Kobayashi et al. | 346/76 PH |
| 2003/0038990 | A1 | 2/2003 | Liberman | |

FOREIGN PATENT DOCUMENTS

| | | |
|---|---|---|
| JP | 56-157389 | * 12/1981 |
| JP | 58 014786 | 1/1983 |
| JP | 60 011377 | 1/1985 |
| JP | 61 121971 | 6/1986 |
| JP | 62 042863 | 2/1987 |
| JP | 01 136773 | 5/1989 |

* cited by examiner

*Primary Examiner*—Huan Tran

(57) ABSTRACT

There is disclosed a thermal print head platen which includes a pair of support members separated by a gap wherein the support members are adapted to be oriented to press media against a thermal print head for printing purposes with the gap approximately aligned with a heating element located within the print head. There are also described a thermal printer which includes at least one thermal print head in conjunction with a thermal print head platen to pressure print media against the thermal print head for printing purposes and a thermal printing method utilizing such a thermal printer.

29 Claims, 7 Drawing Sheets

PLATEN ASSEMBLY FOR THERMAL PRINTER

REFERENCE TO RELATED APPLICATIONS

This application claims the benefit of provisional application Ser. No. 60/449,737, filed Feb. 24, 2003.

BACKGROUND OF THE DISCLOSURE

Platen rollers are commonly used in linear or serial printing to provide a firm foundation for various forms of print heads. In thermal printers, platen rollers are used for squeezing print media against a thermal print head to provide proper thermal conduction between the print head and media. Platen rollers can also allow accurate movement of print media due to minimal friction characteristics. Certain types of thermal print heads are restricted to using a maximum radius platen roller, thus requiring a certain roller wrap and curvature to the print media.

The use of rotating platen rollers in conjunction with thermal print heads presents considerable alignment, manufacturing and cost considerations. The development of thermal printers has typically included the use of platen rollers having a deformable rubber coating. Such platen rollers are used to pressure print media against integrated circuit, thermal print heads for providing sufficient thermal contact and heat transfer to the print media. The rubber surface of the platen roller deforms when the roller is pressing the print media against the thermal print head. With such platen rollers more energy may be needed to obtain the same optical density in the printed image when the thermal element in the print head does not conform to the shape of the platen roller surface when they are in contact with each other.

During rotation all imperfections related to rubber rollers such as eccentricity, roundness, circumferential and longitudinal stiffness variations, bearing imperfections, etc. are detrimental to printed image quality.

As the state of the art in thermal printers advances and efforts are made to provide new thermal printers that can meet new performance requirements and substantially reduce or eliminate some of the undesirable characteristics of the known thermal printers, it would be advantageous to have a thermal printer which does not require a rotating platen roller.

SUMMARY OF THE INVENTION

It is therefore an object of this invention to provide a novel platen for use in a thermal printer.

It is another object of the invention to provide a non-rotating platen for use in a thermal printer.

It is yet another object of the invention to provide a non-rotating platen which includes a gap in the surface thereof which comes into contact with the print media.

Another object is to provide a thermal printer which includes a non-rotating platen to press print media against a thermal print head.

Still another object is to provide a thermal printing method in which a non-rotating platen is used to press print media against a thermal print head.

In one aspect of the invention there is provided a non-rotating print head platen for use in conjunction with a thermal print head in a thermal printer. The platen includes a pair of support members, or surfaces, separated by a gap, wherein the support members are adapted to be oriented to press print media against a thermal print head for printing purposes with the gap approximately aligned with a heating element located within the print head.

The support members and the gap may be elongated and adapted for substantially parallel alignment with a thermal print head having a linear array of heating elements for printing purposes. The thermal print head may include an elongated convex surface in parallel relation to the linear array of heating elements, with the linear array of heating elements located approximately at an apex of the elongated convex surface.

The platen may be adapted to provide an overall convex path for print media relative to the thermal print head for printing purposes. The platen may have an elongated overall convex surface including a convex cross sectional shape adapted for providing the overall convex print media path. The support members may extend from the overall cross sectional surface of the platen. The platen may further include a frame adapted for mounting the platen and allowing movement of the platen towards and away from a print head for printing purposes, while limiting movement of the platen in an orthogonal direction directly between the support members and across the gap. The frame may include at least one pair of limiting members located on opposing sides of the platen and adapted to contact a portion of the overall convex surface of the platen, and a mechanical bias mechanism adapted to bias the platen to cause the convex surface to contact the limiting members. The limiting members may be adapted to allow movement of the platen directly towards the frame and against the bias mechanism. The limiting members may also be adapted to contact opposing sides of the platen and limit movement of the platen in opposing directions directly between the support members and across the gap.

In another aspect of the invention there is provided a thermal printer which includes at least one thermal print head in conjunction with a non-rotating platen to pressure print media against the thermal print head. The thermal print head may be biased against a stationary platen such as by a spring or the platen may be spring-loaded against a stationary print head.

In a further aspect of the invention there is provided a thermal imaging method wherein print media are pressured against a thermal print head by a non-rotating platen.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DETAILED DESCRIPTION OF THE PREFERRED EMBODIMENTS

Figure 1:
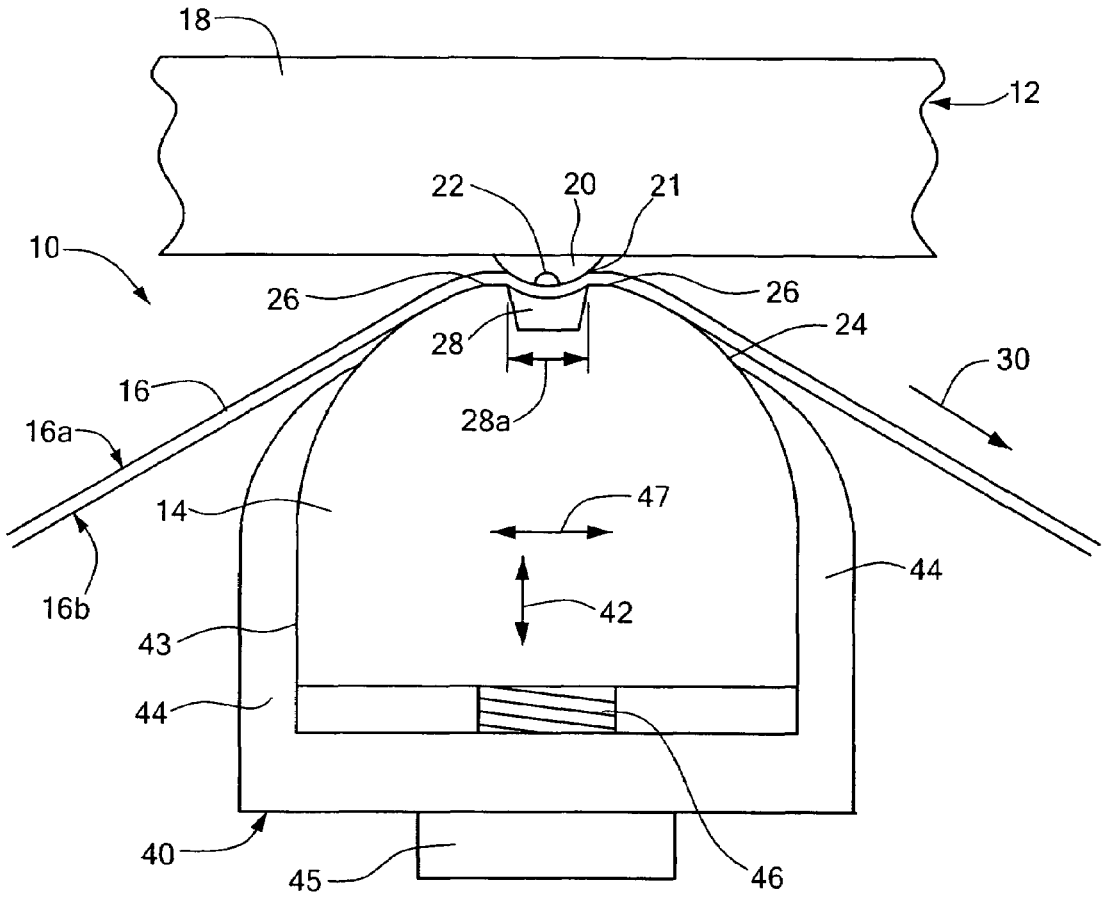
FIG. 1 is a cross sectional view of a thermal platen and print head arrangement.

Referring now to FIG. 1 there is shown a thermal printing arrangement 10 according to the invention generally including a thermal print head 12, a non-rotating platen 14 and a portion of print media 16 squeezed between thermal print head 12 and platen 14 for printing purposes.

Thermal print head 12 includes a semiconductor substrate 18 and a convex shaped printing element 20 including an individual heating element 22. Heating element 22, as shown, is preferably located substantially at the apex of convex surface 21 of printing element 20. In addition to heating element 22, printing element 20 is constructed with a glaze material mounted on substrate 18.

Platen 14 generally includes a generally convex platen surface 24, a pair of supporting members 26 formed as a portion of platen surface 24, and a central notch or gap 28. Print media 16 is intended to be pulled between print head 12 and platen 14 in the direction of arrow 30, for purposes of printing along the upper surface 16*a* of print media 16.

Platen 14 is oriented with respect to print head 12 in a manner which approximately aligns gap 28 with heating element 22. Such alignment and the presence of gap 28 causes print media 16 to deform over the length 28*a* of gap 28, causing print media 16 to wrap around and conform to the convex surface 21 of print element 20. This partial wrapping of print media 16 on convex surface 21 enables adequate thermal contact between heating element 22 and print media 16. The presence of air within gap 28 on the non-printing side 16*b* of print media 16 minimizes thermal conduction away from print media 16 and thereby ensures efficient and timely use of heat from heating element 22 in the chemical thermal printing process.

The use of gap 28 is very tolerant of minor inaccuracies in the location of heating element 22 with respect to the apex of convex surface 21, because print media 16 is maintained in good thermal contact with printing element 20 over a much greater length 28*a* than the width of heating element 22. In one arrangement, gap 28 is approximately two millimeters across, while heating element has a typical dimension of 80 microns. This order of magnitude difference (25 times) virtually eliminates significant alignment problems, such as those experienced with roller platens.

The dimensions of gap 28 as well as the overall print media path curvature are design considerations that are related to various considerations including the stiffness of the print media. Stiffer print media such as plastic and photo quality paper, generally require a larger gap to insure adequate wrapping of the media around printing element 20. Stiffer print media also allow less curvature of the print media path around the platen because the surface tension produced by bending the media reduces its flexibility to wrap around the printing element. For this reason, platens and even printers can be designed for different types of print media. Optimum gap spacing for any particular thermal printer in relation to the type of print media can be determined by routine scooping experiments.

To further aid those skilled in the art to practice the invention the following formulas are given to provide an approximation of the gap spacing 28*a* for any particular embodiment according to the invention taking into account the specific print media and the platen:

$$y = \frac{(w)(L^3)}{48(E)(I)} \tag{1}$$

$$I = \frac{(b)(h^3)}{12} \tag{2}$$

$$w = \frac{W}{40} \tag{3}$$

where:

E represents Young's modulus of the print media in psi;

I represents the area moment of inertia of the platen in inches$^4$;

W represents the load in lbs;

b represents the width of a discrete section of the print media in inches;

h represents the thickness of the print media in inches;

w represents the bending force applied to a 0.1 inch section of a 4 inch wide print media in lbs.;

y represents the maximum deflection of a discrete section of the print media in inches (which is considered to be equal to the height of glazing of the thermal print head); and L represents the gap width in inches.

Using these formulas, there is calculated for a print media material such as the type described in United States Patent Application Publication No. US 2003/015206 A1 and further described with respect to the print media used in the Example recited below herein, a gap width of about 0.08 inch.

It should be kept in mind that FIG. 1 is a cross sectional view taken parallel to the direction 30 of print media movement. Thermal print heads are typically constructed as an elongated linear array, or single row of heating elements of which element 22 is only one. Such a row or linear array would extend perpendicular to the surface of FIG. 1. Platen 14 is correspondingly elongated in the same manner, as shown by the example in FIG. 2, to accommodate an elongated row of heating elements.

FIG. 1 shows a frame 40 which provides mounting of platen 14 and allows movement thereof in the direction of opposing arrows 42, directly towards and away from print head 12 during printing operations. Frame 40 includes one or more pairs of opposed limiting members 44. Limiting members 44 are located on opposing sides of platen 14 and are adapted to contact a portion of the convex surface 24 to create a limit for the movement of platen 14 towards print head 12 and away from frame 40. Platen 14 is biased in this direction towards print head 12 and against the limits of members 44 by one or more bias mechanisms 46. In this manner frame 40 is used to press platen 14 against print media 16 and print head 12, causing some displacement of platen 14 down from the limits of members 44. This arrangement creates adequate pressure for biasing print media 16 against printing element 20 and enables minor movements of platen 14 to maintain relatively constant pressure on print media 16 throughout the normal variations in the printing process. Bias mechanism 46 may be made to be adjustable by a thumb screw 45.

Members 44 further include a flat side portion 43, which corresponds to and closely contacts a complementary flat portion of platen 14, irrespective of the previously described movement of platen 14. In this manner, platen 14 is restricted from movement in the relative orthogonal direction of arrows 47 with respect to the enabled movement in the direction of arrows 42. Thus, friction caused by the pulling of print media 16 in the direction of arrow 30 fails to disrupt the position of platen 14 and maintains gap 28 in alignment with heating element 22.

Figure 2:
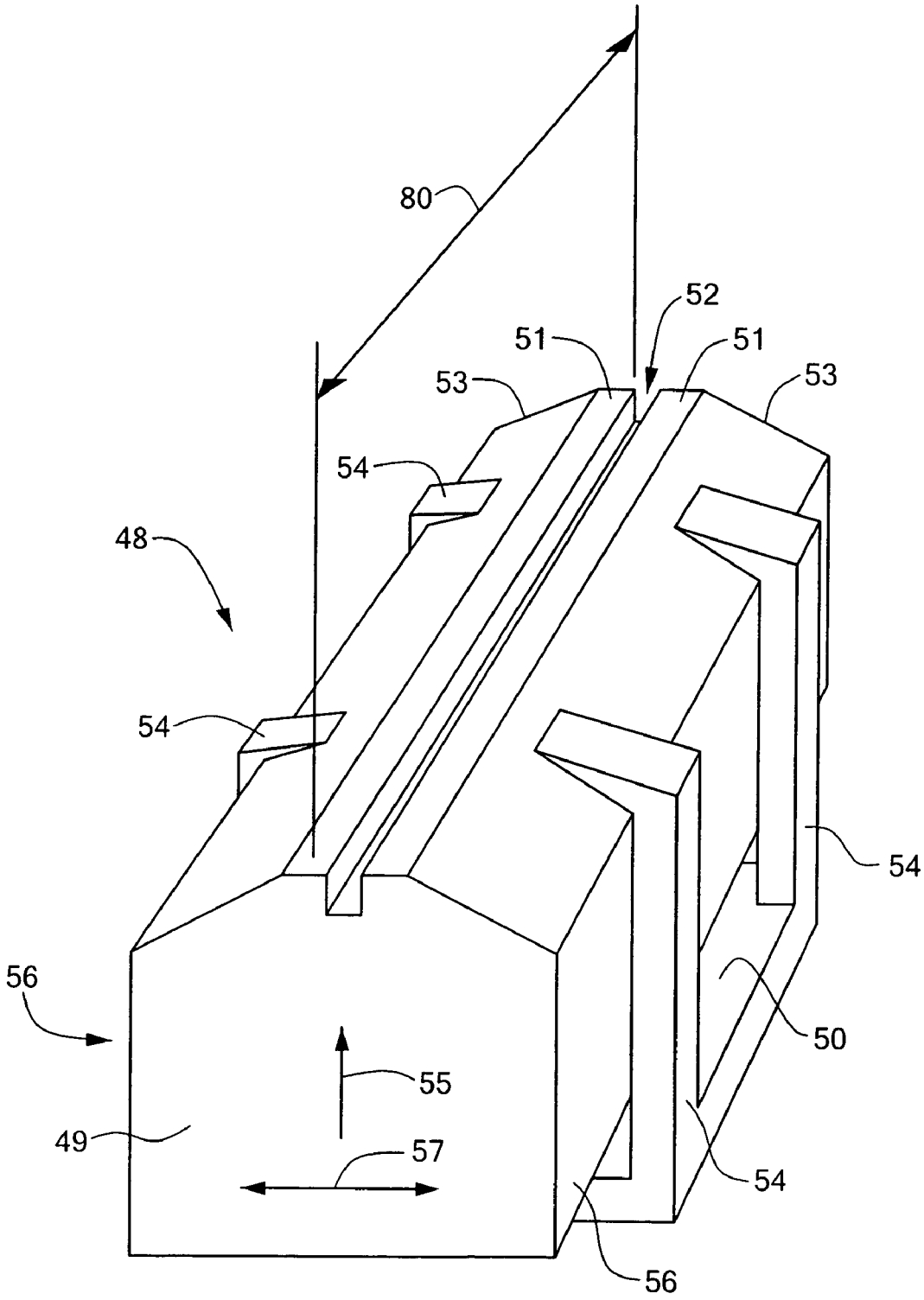
FIG. 2 is a perspective view of another platen assembly.

FIG. 2 shows another platen assembly 48 including platen 49 and frame 50. Platen 48 includes elongated support members 51 in parallel alignment on either side of a groove or elongated gap 52. Where platen 14 (FIG. 1) includes curved surface 24, platen 49 includes flat diagonal surfaces 53, which still affords platen 49 an overall convex surface for providing a curved print media path.

Frame 50 includes two pairs of limiting members 54 which are adapted to contact diagonal surfaces 53 and limit the movement of platen 49 in the direction of arrow 55. Each pair of limiting members 54 is located on opposing sides of platen 49 and are adapted to contact opposing sides 56 of platen 49 and thereby prevent movement of platen 49 in the direction of arrows 57. Platen 49 would be biased against limiting members 54 in the same manner as platen 14 (FIG. 1), by individual bias mechanisms (not shown) mounted to frame 50 in between each opposed pair of limiting members 54. Thus, platen 49 is intended to pressure print media against an elongated thermal print head in the same manner as print head 14 (FIG. 1). The movement of each bias mechanism is independent, which allows platen 49 to tilt relative to frame 50. This allows platen 49 to better conform to a print head. Although, two pair of limiting members 54 and two bias mechanisms are intended for mounting platen 49, sufficient mounting may be achieved with a different number, depending upon the printer application.

Although limiting members 44, 54 are all shown to contact the upper surfaces of their respective platens 14, 49 those platens may also be constructed with recesses in their upper surfaces, and even their sides, to accommodate the limiting members, depending upon specific printer applications. Such an arrangement would allow larger and stronger limiting members to be used while removing any possible interference between the limiting members and print media. The side walls of such recesses could be constructed vertically in the views shown (parallel to the direction of allowed platen movement) and thereby provide more lateral sliding contact with the limiting members to improve lateral stability of the platens. Such recesses would also be constructed wider than their respective limiting members to allow the aforesaid tilting of the platen.

Figure 3:
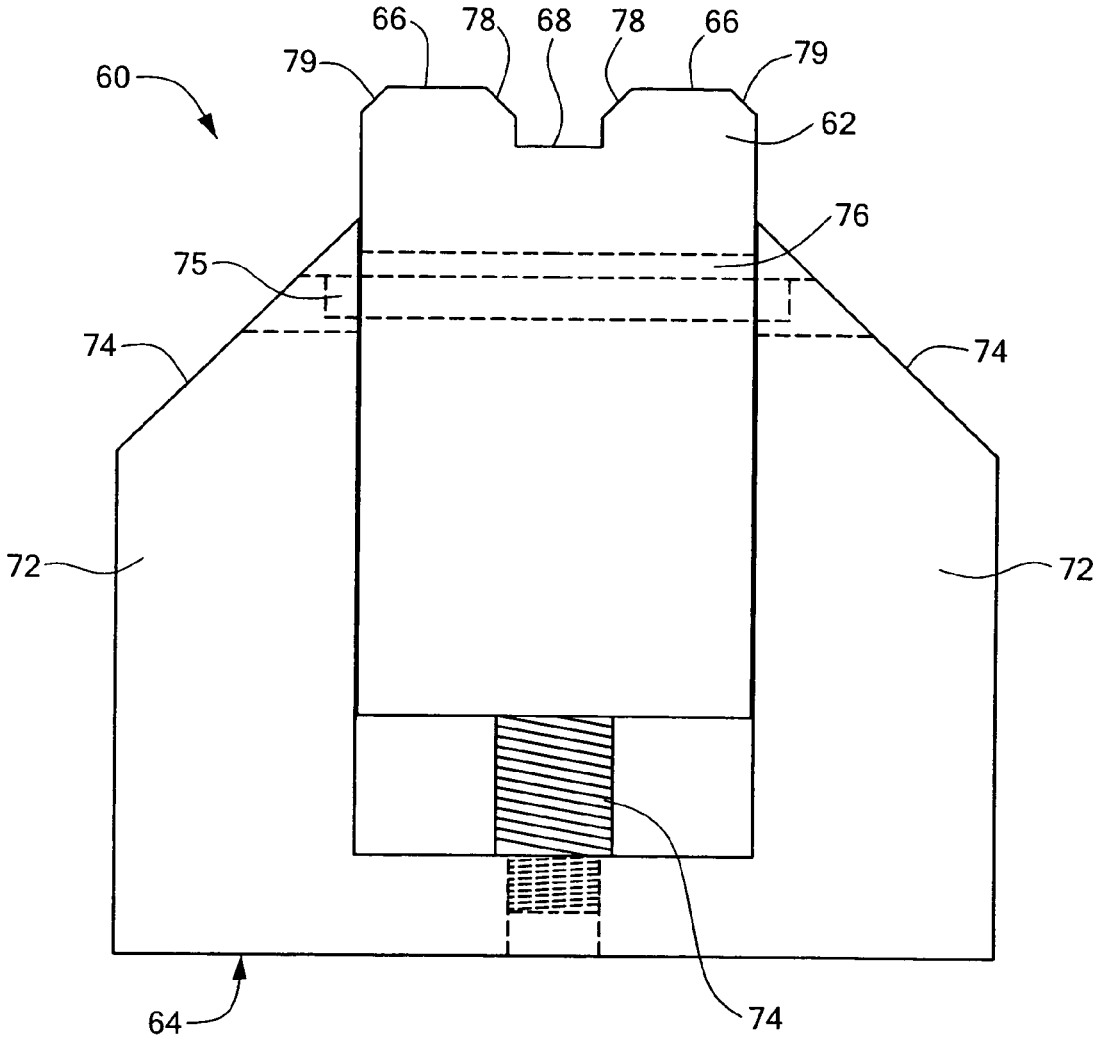
FIG. 3 is a cross sectional view of yet another platen assembly.

FIG. 3 shows a cross sectional view of yet another embodiment of the current platen including a platen assembly 60 with a platen 62 and a frame 64. Platen 62 includes a pair of elongated support members 66 located parallel to and on either side of an elongated gap 68. Platen 62 is similarly mounted to frame 64 by two opposing pairs of limiting members 72 and biased by one or more adjustable spring bias mechanisms 74.

Platen 62 has a narrower construction than previous embodiments and by itself, lacks the overall convex shape of the previous embodiment. Instead, limiting members 72 may be described as maintaining an overall convex shape for printer design purposes, through the use of slanted top portions 74. Because of this lack of an overall convex shape to platen 62, limiting members 72 engage and limit the movement of platen 62 somewhat differently. Any suitable limiting and engagement mechanism may be used, such as a bolt 75 passing through an oversize bore 76 in platen 62. Other approaches may include complementary ledges formed in the contacting surfaces of platen 62 and limiting members 72.

Platen 62 is further characterized by the absence of right angle edges along both the inside edges 78 and the outside edges 79 of support members 66. This may be accomplished by any suitable construction, such as either beveling or the formation of diagonal surfaces along those edges as shown. The absence of right angle edges reduces sheer forces and friction acting on the pulled print media.

Each of the platens 14, 49, 62 shares the characteristic that they are mounted by limiting members 44, 54, 72, respectively, within their working length 80 (FIG. 2). Thus, because the present platens 14, 49, 62 do not rotate, they do not require extensions for bearings at each end in the same manner as roller platens.

This internal mounting arrangement, within working length 80, has the further advantage that it reduces bending stress on the platen and allows construction of a platen that is less stiff than a roller platen of similar working length supported at its ends. In other words, the present platen assembly 48 provides the same functional stiffness as an end mounted roller platen with reduced stiffness required for the platen 49 itself. This is demonstrated by platen 49 (FIG. 2), wherein limiting members 54 and the biasing means (not shown), which are intended to support platen 49, are each located approximately half way between the center of platen 49 and each respective end. Because stiffness is proportional to the third power of length for suspended elements, platen 49 (FIG. 2) uses approximately half the suspended length of an end mounted platen roller and therefore needs to be $2^3$, or eight times less stiff. The precise location for support by the bias mechanisms may be readily calculated to achieve the most uniform stiffness of the platen and thereby minimize construction cost and complexity of such platens.

The present platen has the advantages of reducing the number of parts, including moving parts, in platen assemblies. Wrapping print media over the printing element provides a wide, non-critical, contact area for the heating element without the use of deformable rubber. Thus, platen to print head pressure does not need to be removed when a printer is not in use to prevent platen rubber degradation. The use of air insulation opposing the heating elements increases printing efficiency over roller platens and may readily be used in place of many roller platens in printer applications. Most important is the significantly better alignment offered by the present platens. Roller platens are never perfectly parallel throughout their rotation and thereby always tend to cause steering of long pieces of print media. The present platens do not need precision alignment. The enabled mounting arrangement improves the component density of multiple head printers and reduces the required platen stiffness.

Figure 4:
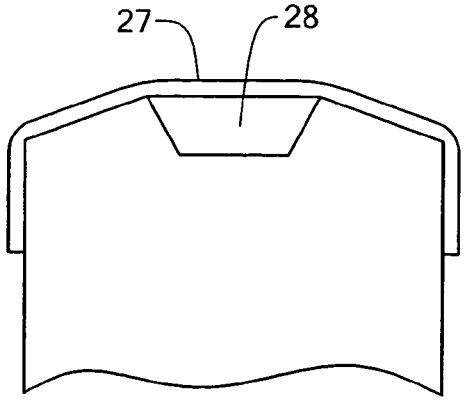
FIG. 4 is a cross-sectional view of an embodiment of a thermal platen according to the invention.

In FIG. 4 there is shown a cross-section of another arrangement of a non-rotating platen according to the invention. The non-rotating platen illustrated in FIG. 4 further includes a member, which may be in the form of a layer 27 arranged so as to extend over gap 28, as illustrated in FIG. 4, or which may be inserted in the gap itself as will be described in detail with respect to FIG. 6. The member is arranged such that print media 16 comes into contact with the member as the media travels across the platen. The member assists the print media to better conform to the shape of the printing element 20.

The member may comprise any material which is relatively soft, thermally stable at the temperatures present in the area beneath the thermal print head (typically in the range of from about 80° C. to about 250° C.) and has a relatively low coefficient of friction to allow the print media to move across the surface without any substantial frictional impact. A wide variety of materials may be used for this purpose including, for example, natural materials, synthetic polymeric materials and the like. Preferably layer 27 comprises a base, or substrate, in the form of a sheet having fibers or other elements extending therefrom with the material being arranged such that the fibers or other elements are in contact with the print media.

A particularly preferred material for layer 27 is ULTRA-MATE® BRAND Narrow Closure HTH 830 available from Velcro USA, Manchester, N.H. 03103. Other Velcro grades are also suitable for use. Generally, Velcro materials have a sheet-form base and an array of fastener elements extending from the base.

Figure 5:
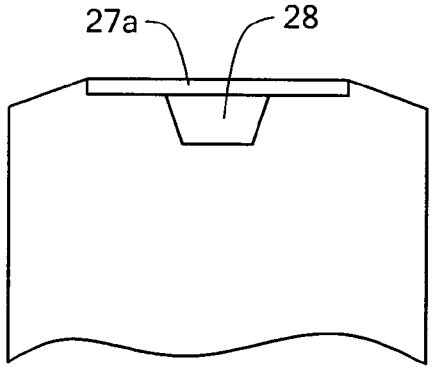
FIG. 5 is a cross-sectional view of another embodiment of a thermal platen according to the invention.

In FIG. 5 there is shown a cross-section of another non-rotating platen according to the invention wherein the layer 27 is arranged in a recess formed in the platen.

Figure 6:
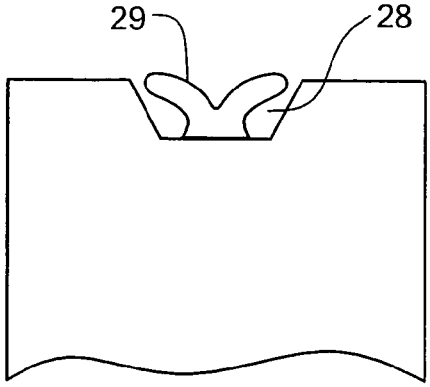
FIG. 6 is a cross-sectional view of another embodiment of a thermal platen according to the invention.

In FIG. 6 there is illustrated another embodiment of a platen according to the invention wherein the member 29 is arranged in the gap 28 of the platen. In this illustrative instance, the member can be of various materials. A preferred material is a solid strand of Somos® 8110 epoxy photopolymer, available from DSM Somos, New Castle, Del.

The invention will now be described further with respect to a specific preferred embodiment by way of an example, it being understood that the example is intended to be illustrative only and the invention is not limited to the materials, amounts, procedures and process parameters, etc. recited therein. All parts and percentages are by weight unless otherwise specified.

EXAMPLE

The thermal print head used was a Kyocera KPT-163 printer with a heater element resistance of 3000 ohms. The print head was operated at a voltage of 38 volts.

The print media was of the type described in United States Patent Application Publication No. US 2003/015206 A1. The print media comprised a substrate carrying on a first side, in succession, a magenta color-forming system and a yellow color-forming system, both color-forming systems including a colorless leuco dye in combination with a leuco dye developer and carrying on a second side a cyan color-forming system including a colorless compound. The color-forming layers formed color upon exposure to heat.

The non-rotating platen according to the invention was similar to that shown in FIG. 4. The member arranged over the platen was ULTRA-MATE® BRAND Narrow Closure HTH 830. A conventional 18 mm rubber coated roller (prior art) was used for comparative purposes.

Figure 7:
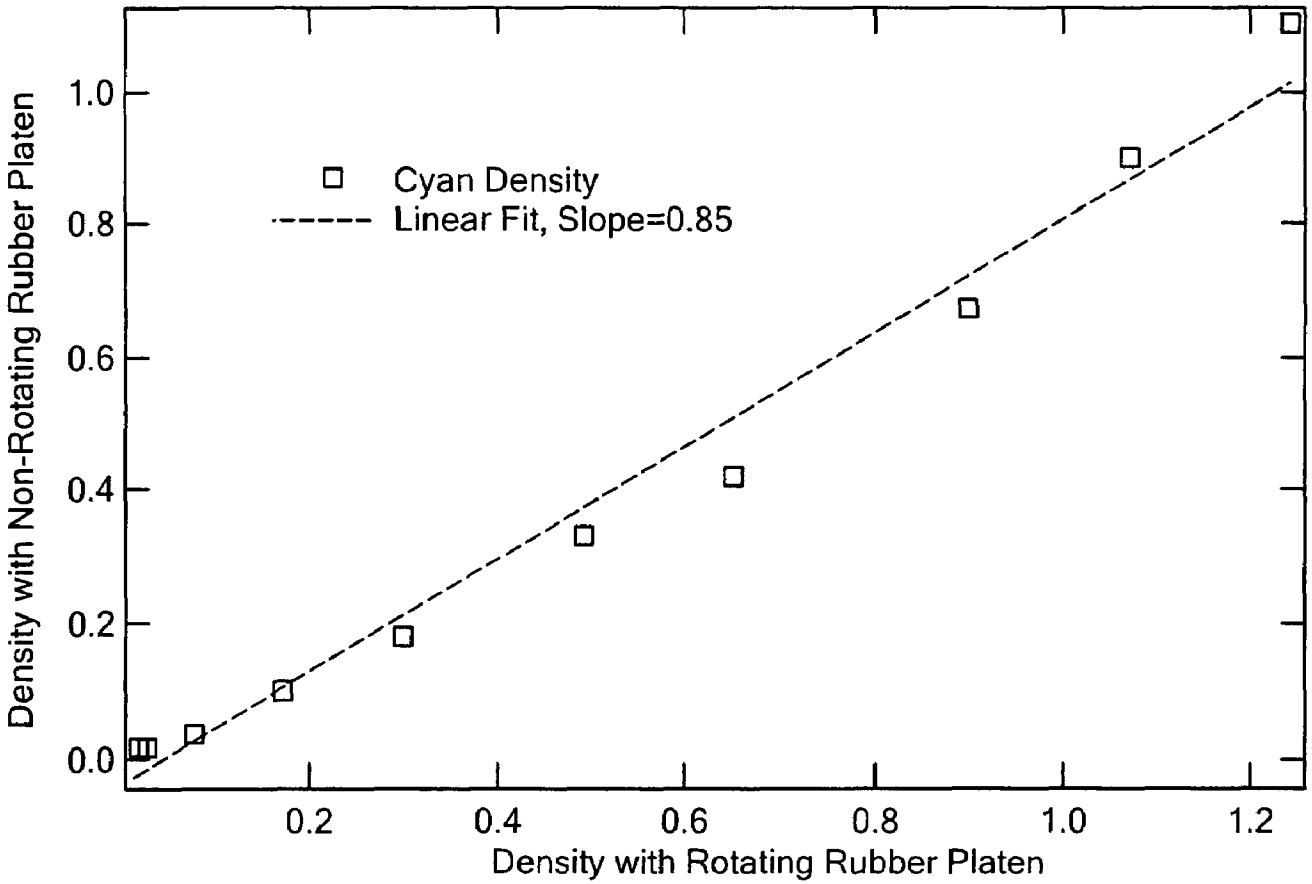
FIG. 7 is a graphical representation of the cyan densities obtained from experiments carried out with a thermal printing arrangement using a conventional rubber coated platen roller and one using a non-rotating platen according to the invention.
Figure 8:
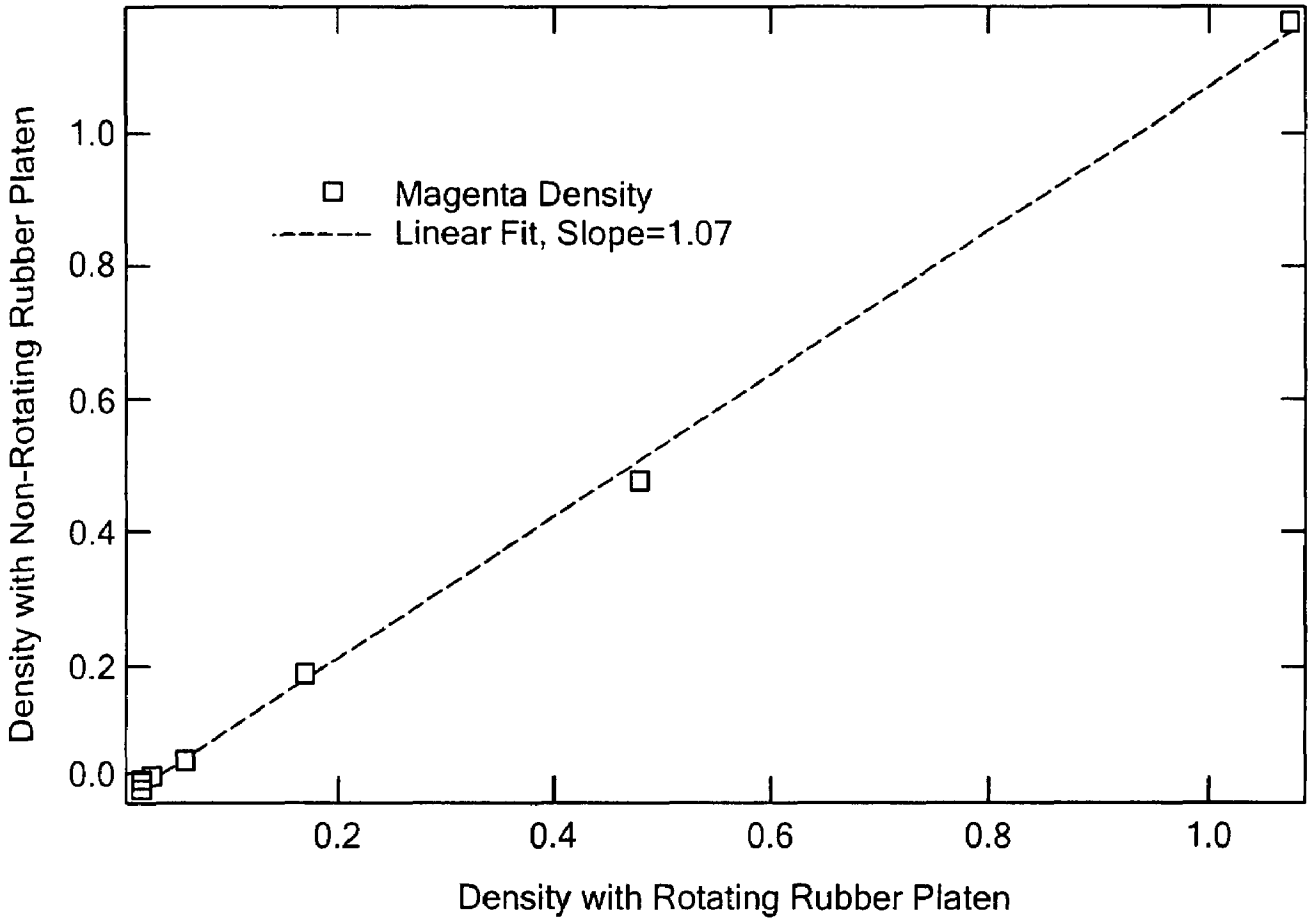
FIG. 8 is a graphical representation of the magenta densities obtained from the experiments.
Figure 9:
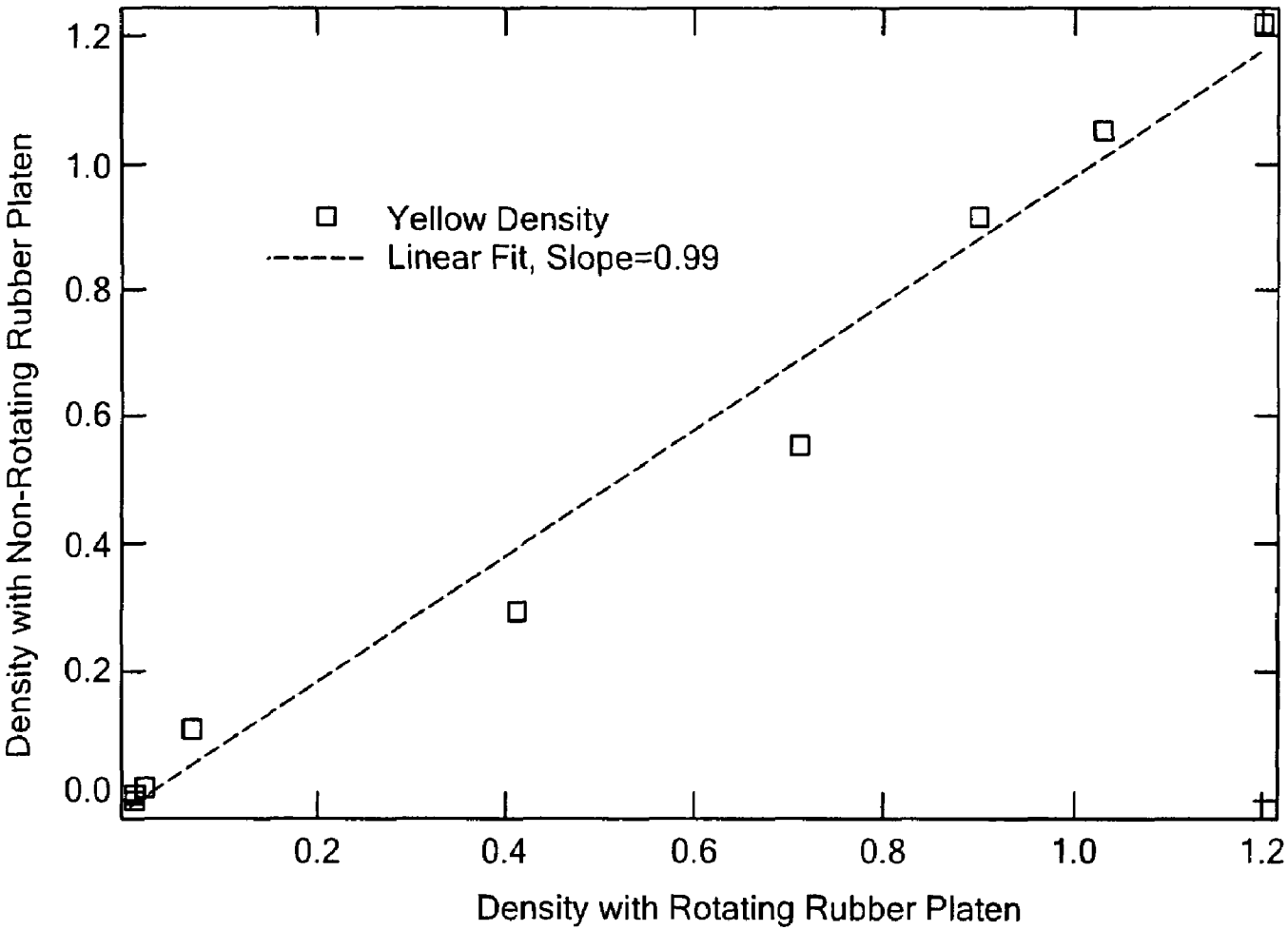
FIG. 9 is a graphical representation of the yellow densities obtained from the experiments.

The printed images were composed of 1 $cm^2$ patches of increasing optical density. Patches of cyan, magenta and yellow were used. In each of FIGS. 7, 8 and 9, respectively, there are illustrated comparisons between the cyan, magenta and yellow densities obtained with the non-rotating platen of the invention and the prior art rotating rubber covered platen roller. It can be seen that the slope of the linear fit in all three cases is close to 1.0 (within 15%).

These data show that the thermal printer with the non-rotating platen according to the invention can provide substantially the same or similar color densities as a thermal printer with a conventional rubber coated platen roller for the same energy input.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

What is claimed is:

1. A thermal print head platen comprising a pair of support members separated by a gap, wherein said support members are adapted to be oriented to press print media against a thermal print head for printing purposes with said gap approximately aligned with a heating element located within said print head; and a frame adapted for mounting said platen and allowing movement of said platen towards and away from a print head for printing purposes, while limiting movement of said platen in an orthogonal direction directly between said support members and across said gap.

2. The thermal platen as defined in claim 1, wherein said print head includes a convex surface relative to said support members for printing purposes and said heating element is located approximately at an apex of said convex surface relative to said support members for printing purposes.

3. The thermal platen as defined in claim 1, wherein said support members and said gap are elongated and adapted for substantially parallel alignment with a thermal print head having a linear array of heating elements for printing purposes.

4. The thermal platen as defined in claim 3, wherein said thermal print head includes an elongated convex surface in parallel relation to said linear array of heating elements, with said linear array of heating elements located approximately at an apex of said elongated convex surface.

5. The thermal platen as defined in claim 3, wherein said platen is adapted to provide an overall convex path for print media relative to the thermal print head for printing purposes.

6. The thermal platen as defined in claim 5, wherein said platen has an elongated overall convex surface including a convex cross sectional shape adapted for providing said overall convex print media path.

7. The thermal platen as defined in claim 6, wherein said support members extend from said overall cross sectional surface of said platen.

8. The thermal platen as defined in claim 1, wherein said frame comprises at least one pair of limiting members located on opposing sides of said platen and adapted to contact a portion of said convex surface of said platen, and a mechanical bias mechanism adapted to bias said platen to cause said convex surface to contact said limiting members.

9. The thermal platen as defined in claim 8, wherein said limiting members are adapted to allow movement of said platen directly towards said platen and against said bias mechanism.

10. The thermal platen as defined in claim 9, wherein said limiting members are adapted to contact opposing sides of said platen and limit movement of said platen in opposing directions directly between said support members and across said gap.

11. The thermal platen as defined in claim 1, further comprising a member arranged over or in said gap and adapted to conform a print media with a thermal print head having a linear array of heating elements for printing purposes.

12. The thermal platen as defined in claim 11, wherein said member comprises a layer of a material arranged over said gap.

13. The thermal platen as defined in claim 12, wherein said member comprises a layer of material having fibrous or other elements extending from a substrate, said member arranged such that said elements contact print media traveling across said platen.

14. The thermal platen as defined in claim 11, wherein said print head includes a convex surface relative to said support members for printing purposes and said heating element is located approximately at an apex of said convex surface relative to said support members for printing purposes.

15. A thermal printer comprising a thermal print head arranged in operative relationship with a thermal print head platen as defined in claim 1, said thermal print head platen adapted to pressure print media against said thermal print head for printing purposes.

16. The thermal printer as defined in claim 15, wherein said print head includes a convex surface relative to said support members for printing purposes and said heating element is located approximately at an apex of said convex surface relative to said support members for printing purposes.

17. The thermal printer as defined in claim 15, wherein said support members and said gap are elongated and adapted for substantially parallel alignment with a thermal print head having a linear array of heating elements for printing purposes.

18. The thermal printer as defined in claim 17, wherein said thermal print head includes an elongated convex surface in parallel relation to said linear array of heating elements, with said linear array of heating elements located approximately along an apex of said elongated convex surface.

19. The thermal printer as defined in claim 17, wherein said platen is adapted to provide an overall convex path for print media relative to the thermal print head for printing purposes.

20. The thermal printer as defined in claim 19, wherein said platen has an elongated overall convex surface including a convex cross sectional shape adapted for providing said overall convex print media path.

21. The thermal printer as defined in claim 20, wherein said support members extend from said overall cross sectional surface of said platen.

22. The thermal printer as defined in claim 15, wherein said frame comprises at least one pair of limiting members located on opposing sides of said platen and adapted to contact a portion of said convex surface of said platen, and a mechanical bias mechanism adapted to bias said platen to cause said convex surface to contact said limiting members.

23. The thermal printer as defined in claim 22, wherein said limiting members are adapted to allow movement of said platen directly towards said platen and against said bias mechanism.

24. The thermal printer as defined in claim 23, wherein said limiting members are adapted to contact opposing sides of said platen and limit movement of said platen in opposing directions directly between said support members and across said gap.

25. The thermal printer as defined in claim 15, further comprising a member arranged over or in said gap and adapted to conform a print media with a thermal print head having a linear array of heating elements for printing purposes.

26. The thermal printer as defined in claim 25, wherein said member comprises a layer of a material arranged over said gap.

27. The thermal printer as defined in claim 26, wherein said member comprises a layer of material having fibrous or other elements extending from a substrate, said member arranged such that said elements contact print media traveling across said platen.

28. The thermal printer as defined in claim 27, wherein said print head includes a convex surface relative to said support members for printing purposes and said heating element is located approximately at an apex of said convex surface relative to said support members for printing purposes.

29. The thermal printer as defined in claim 15 wherein said thermal print head is stationary and said thermal print head platen is biased against said thermal print head.

* * * * *